US008715024B2

(12) United States Patent
Westwood

(10) Patent No.: US 8,715,024 B2
(45) Date of Patent: May 6, 2014

(54) PERSONAL FLOTATION DEVICE

(75) Inventor: David Westwood, Vancouver (CA)

(73) Assignee: David Westwood, Vancouver (CA)

( * ) Notice: Subject to any disclaimer, the term of this patent is extended or adjusted under 35 U.S.C. 154(b) by 61 days.

(21) Appl. No.: 13/401,235

(22) Filed: Feb. 21, 2012

(65) Prior Publication Data

US 2012/0252291 A1 Oct. 4, 2012

Related U.S. Application Data

(60) Provisional application No. 61/468,144, filed on Mar. 28, 2011.

(51) Int. Cl.
*B63C 9/08* (2006.01)

(52) U.S. Cl.
USPC ..... 441/112; 441/106

(58) Field of Classification Search
USPC ..... 441/88, 106, 108, 112, 113, 116, 117, 441/118
See application file for complete search history.

(56) References Cited

U.S. PATENT DOCUMENTS 2,535,874 A * 12/1950 Starn ..... 441/112
3,681,799 A * 8/1972 Smith ..... 441/112
4,097,947 A 7/1978 Kiefer
4,887,987 A * 12/1989 Kato ..... 441/113
5,382,184 A 1/1995 DiForte, Jr.
5,702,279 A 12/1997 Brown
5,738,557 A 4/1998 Biesecker
5,759,076 A 6/1998 Bateman et al.
5,954,556 A * 9/1999 Powers ..... 441/88
6,004,177 A 12/1999 Biesecker et al.
6,036,562 A 3/2000 Brown
6,066,017 A 5/2000 Max et al.
6,106,348 A 8/2000 Loisel
6,346,022 B1 2/2002 Swanby et al.
6,394,866 B1 5/2002 Brown
6,620,010 B2 * 9/2003 Noonan ..... 441/106
6,755,708 B1 6/2004 McLarty
6,837,764 B2 1/2005 Bradley
7,104,858 B1 9/2006 Yonover
2006/0270290 A1 11/2006 Tellew

* cited by examiner

*Primary Examiner* — Lars A Olson

(74) *Attorney, Agent, or Firm* — Cameron IP

(57) ABSTRACT

A flotation device comprises a shoulder strap and a cross strap connected to the shoulder strap. There is an inflatable bladder extending along the shoulder strap and an inflation means for inflating the inflatable bladder. The shoulder strap is configured to extend over one shoulder of the user and under a first arm of the user. The first arm of the user is opposite to the said one shoulder of the user. The cross strap is configured to extend under a second arm of the user.

19 Claims, 20 Drawing Sheets

PERSONAL FLOTATION DEVICE

CROSS-REFERENCE TO RELATED APPLICATION

This application claims the benefit of provisional application No. 61/468,144 filed in the United States Patent and Trademark Office on Mar. 28, 2011 and priority to which is claimed.

BACKGROUND OF THE INVENTION

1. Field of the Invention

The present invention relates to a personal flotation device and, in particular, to an inflatable personal flotation device.

2. Description of the Related Art

Personal flotation devices are often worn during the performance of water activities such as swimming, surfing, windsurfing, kiteboarding, kitesurfing, wakeboarding, jet skiing, boating, fishing, etc. It is desirable that the personal flotation device used during the performance of water sports be inflatable as opposed to pre-formed from a buoyant material. This is because pre-formed personal flotation devices are typically bulky and may interfere with user motion and performance. Inflatable personal flotation devices can be conveniently carried in a deflated state so as not to interfere with user motion and performance.

There accordingly remains a need for an improved inflatable personal flotation device.

SUMMARY OF THE INVENTION

There is accordingly provided a flotation device for a user. The flotation device comprises a shoulder strap and a cross strap connected to the shoulder strap. There is an inflatable bladder extending along the shoulder strap and an inflation means for inflating the inflatable bladder. The shoulder strap is configured to extend over one shoulder of the user and under a first arm of the user. The first arm of the user is opposite to the said one shoulder of the user. The cross strap is configured to extend under a second arm of the user. The cross strap may be releasably connected to the shoulder strap. The shoulder strap may be adjustable. The cross strap may be substantially horizontal when the user is standing upright.

The flotation device may include an oral inflation tube in fluid communication with the inflatable bladder. The inflatable bladder may be disposed within a pouch, and the pouch may include a flap for accessing the oral inflation tube. The oral inflation tube may include a two-way valve. Alternatively or simultaneously, the inflation device may include a compressed gas inflation system which includes a compressed gas cartridge, a cartridge inflator in fluid communication with the inflatable bladder, and a pull string which when pulled actuates the cartridge inflator to puncture the compressed cartridge resulting in compressed gas being discharged into the inflatable bladder. The pull string may be disposed within a liner. The inflatable bladder may be disposed with a pouch and the pull string may extend through the pouch.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
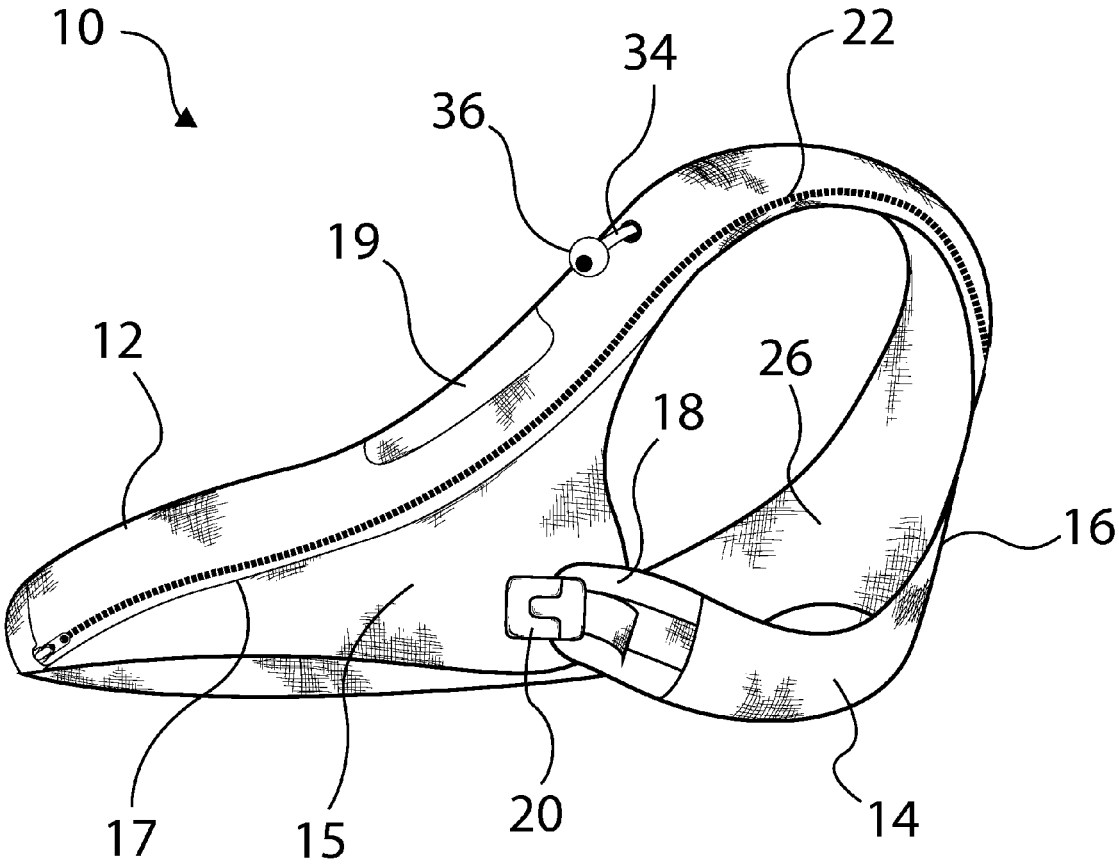
FIG. 1 is a front perspective view of an improved inflatable personal flotation device showing the device in a closed and deflated configuration.

Referring to the drawings and first to FIGS. 1 to 14, an improved inflatable flotation device 10 is shown. The flotation device 10 includes an elongate pouch 12 and a cross strap 14. In this example, and as best shown in FIG. 1, a first end 16 of the cross strap 14 is fixedly connected to a loop-shaped shoulder strap 26 on which the pouch 12 is disposed. A second end 18 of the cross strap 14 is releasably connected to a flap 15 of the shoulder strap 26 which extends along a longitudinal edge 17 of the pouch 12. In this example, a fastener or mating connection in the form of a buckle 20 connects the second end 18 of the cross strap 14 to the shoulder strap 26. The buckle 20 allows for adjustment of the flotation device 10. In other examples, the cross strap may be either fixedly or releasably connected to the shoulder strap at both ends. The cross strap 14 extends substantially horizontal when a user is standing upright as shown in FIGS. 15 to 20. Other means may also be employed to releasably secure the strap to the pouch.

Figure 3:
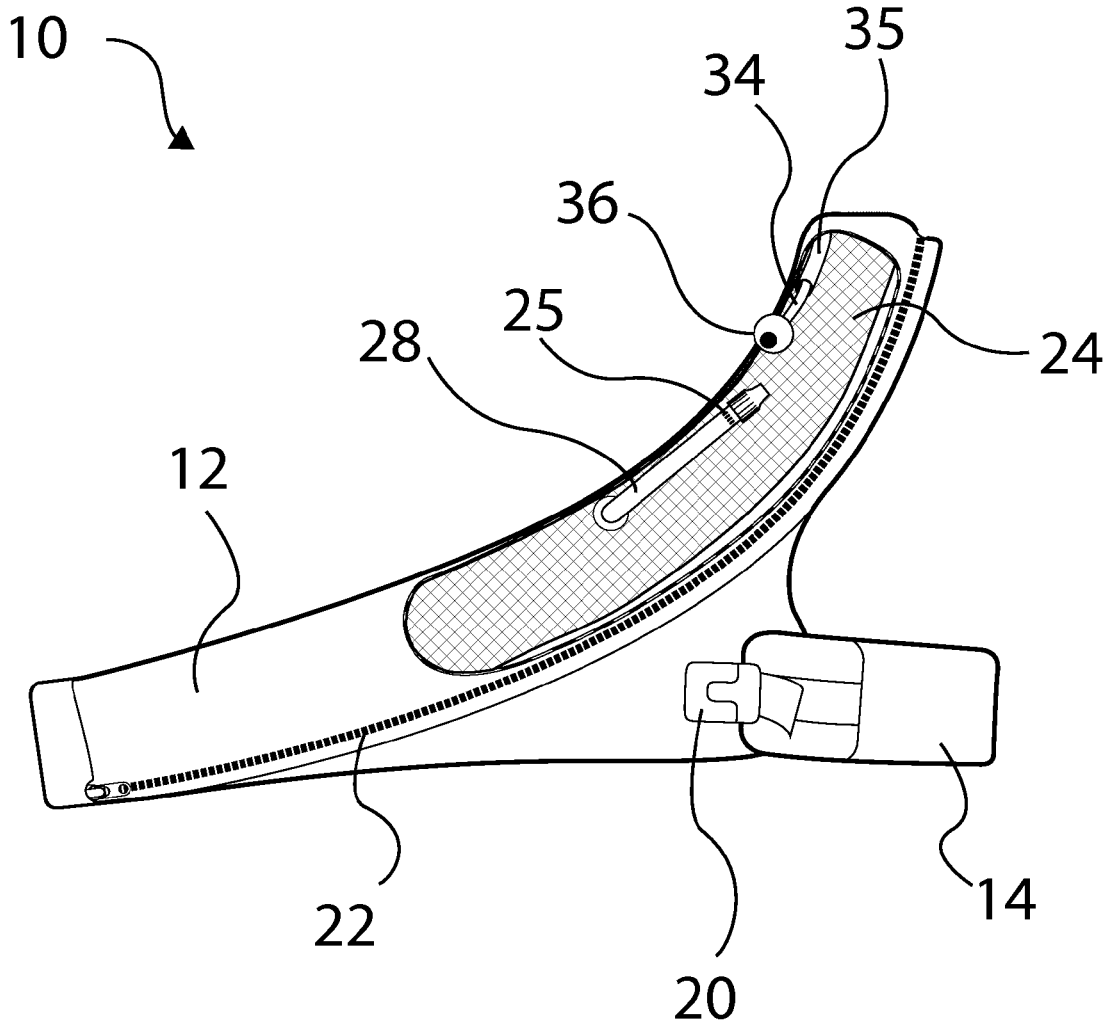
FIG. 3 is a second front elevation thereof showing the flotation device partially cut-away in a closed and deflated configuration.
Figure 4:
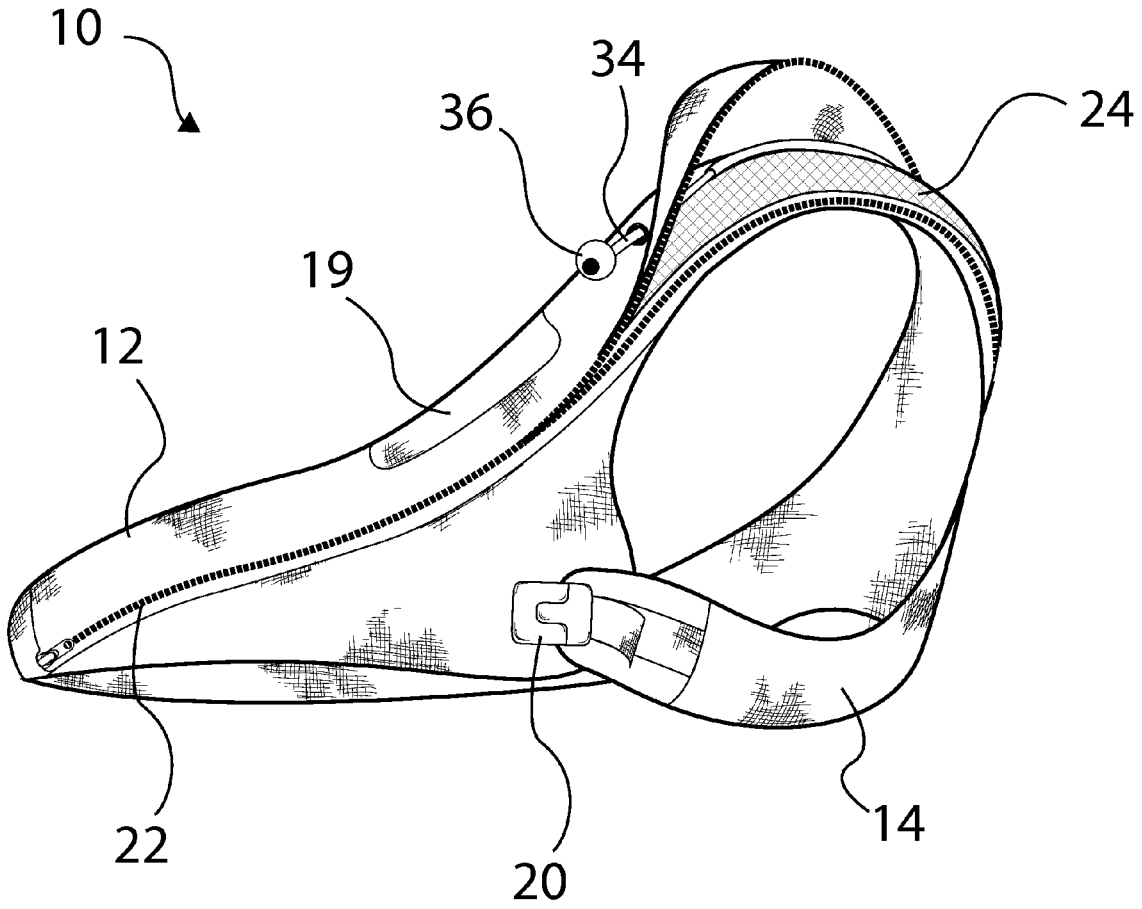
FIG. 4 is a front perspective view thereof showing the flotation device in a partially open and deflated configuration.
Figure 5:
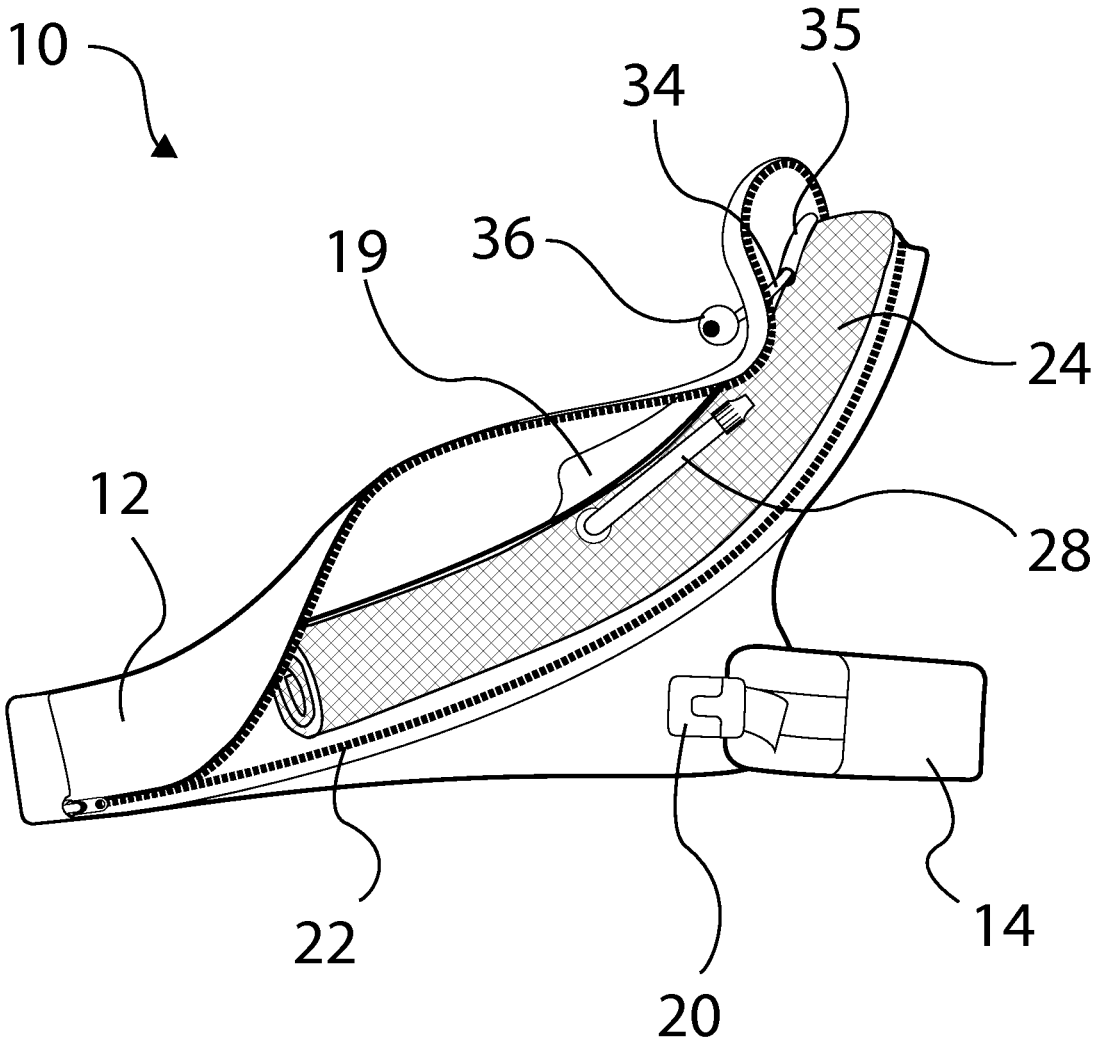
FIG. 5 is a third front elevation view thereof showing the flotation device in a fully open and deflated configuration.
Figure 6:
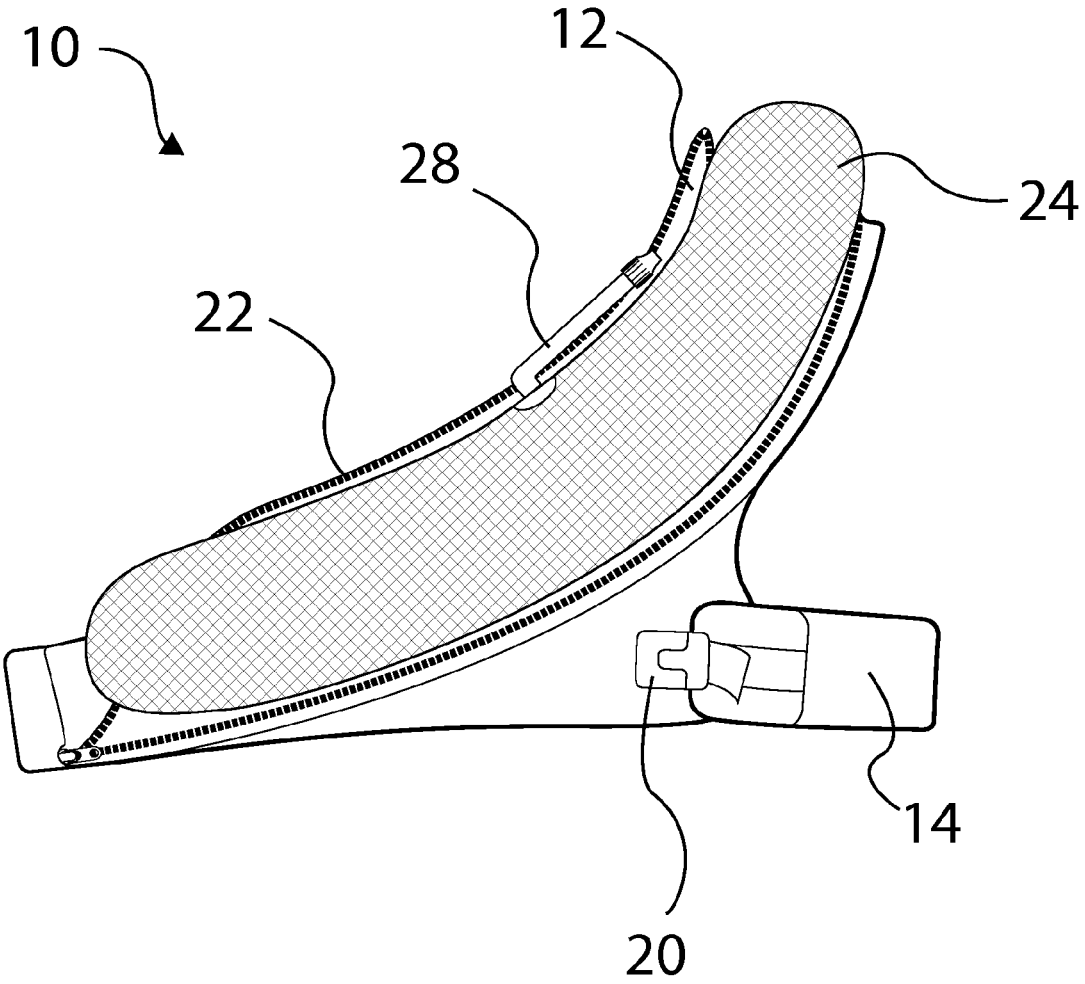
FIG. 6 is a fourth front elevation view thereof showing the flotation device in a fully open and inflated configuration.
Figure 7:
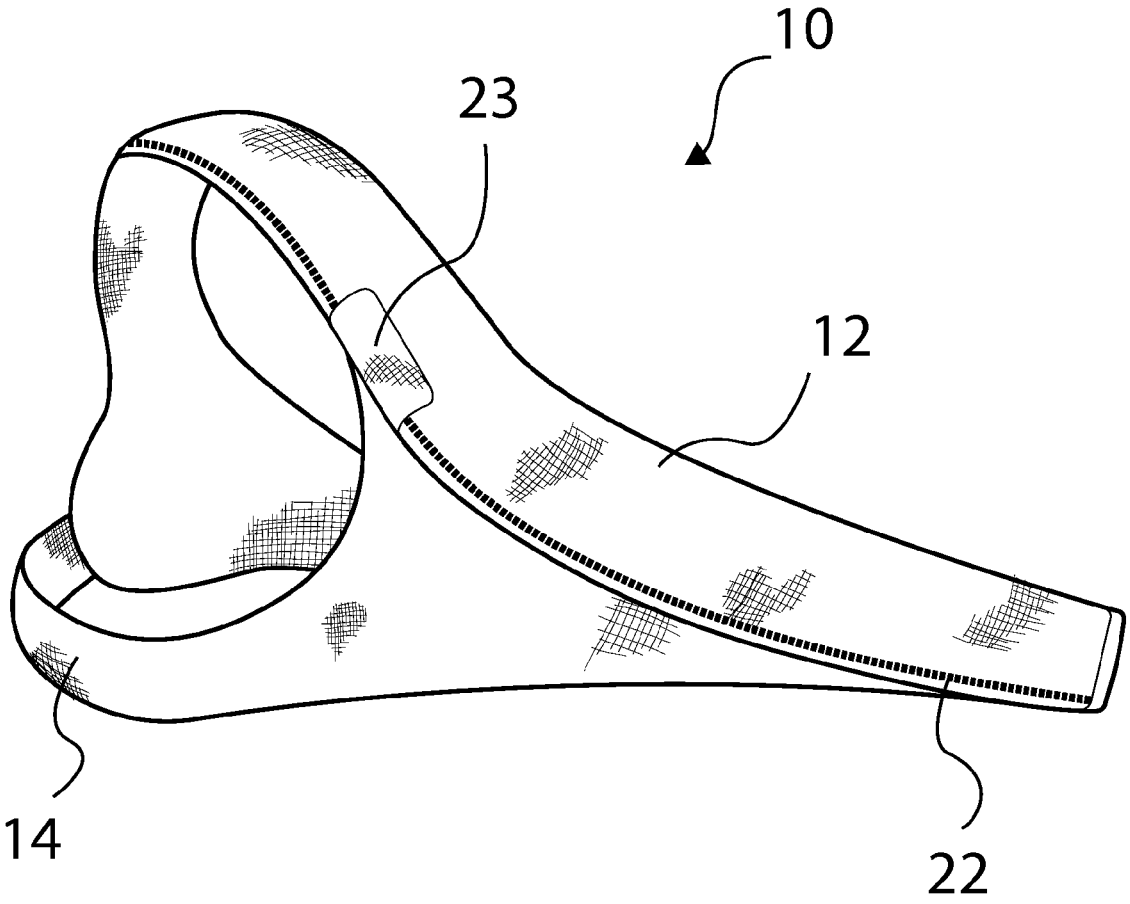
FIG. 7 is a rear perspective view of the personal flotation device showing the device in a closed and deflated configuration.
Figure 9:
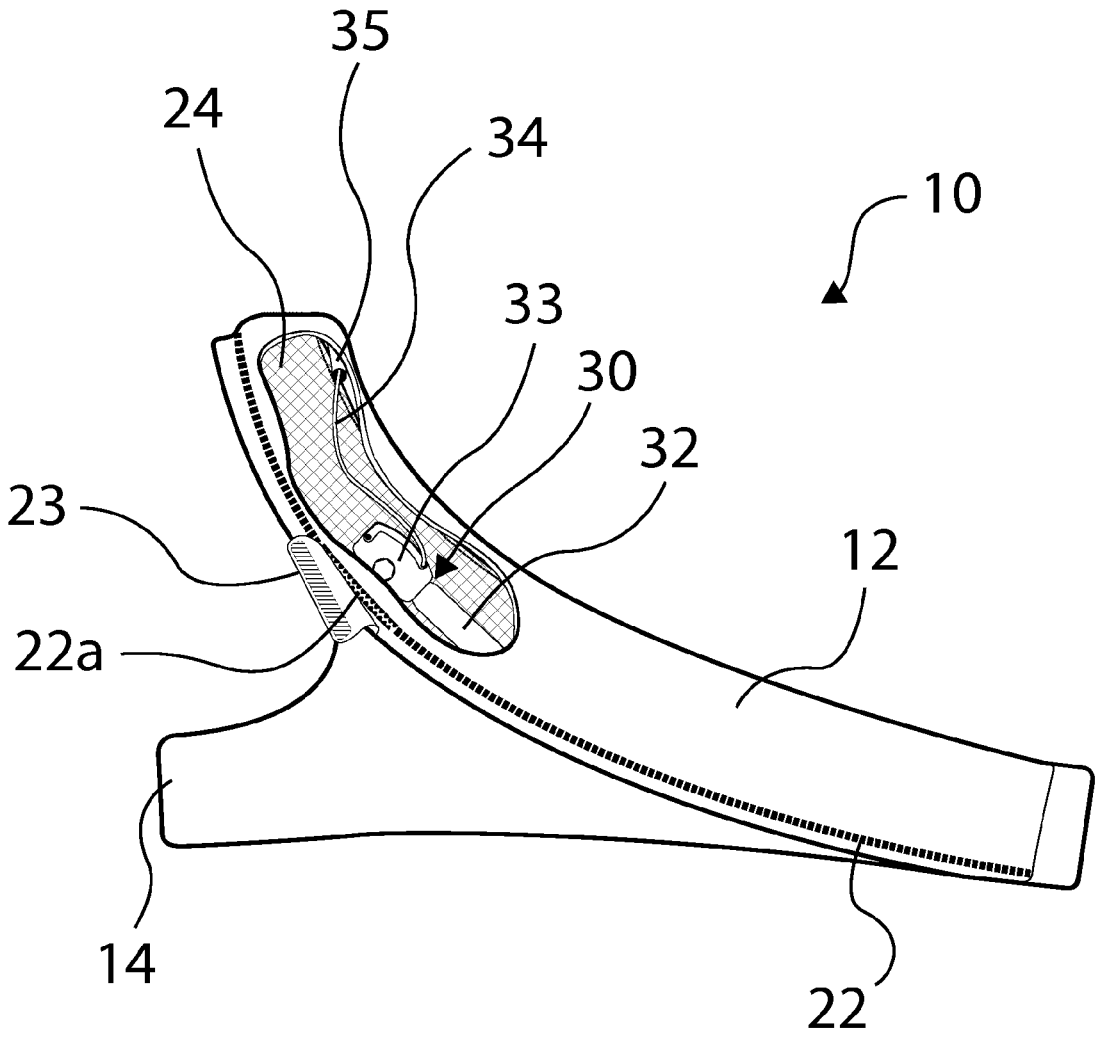
FIG. 9 is a second rear elevation view thereof showing the flotation device partially cut-away in a closed and deflated configuration.
Figure 11:
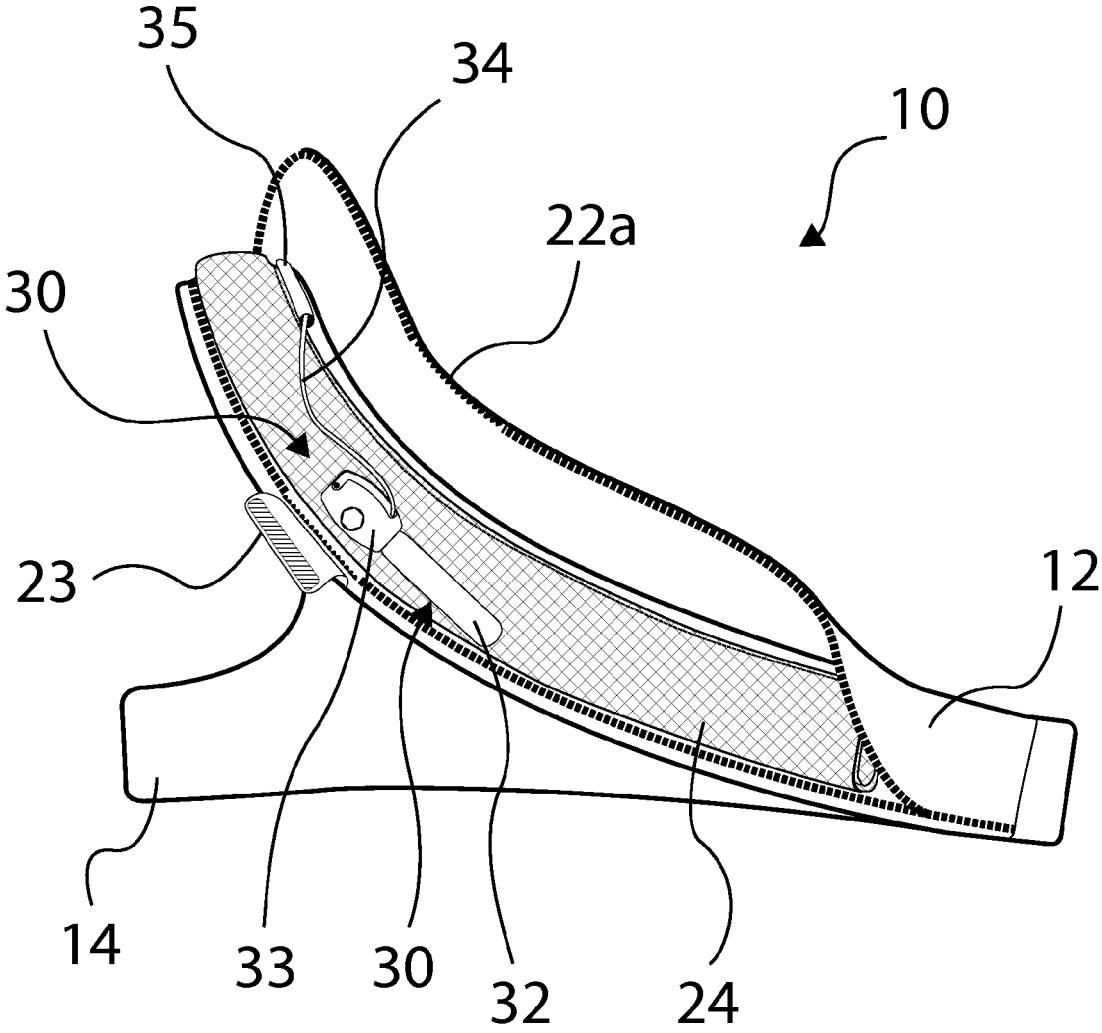
FIG. 11 is a third rear elevation view thereof showing the flotation device in a fully open and deflated configuration.
Figure 12:
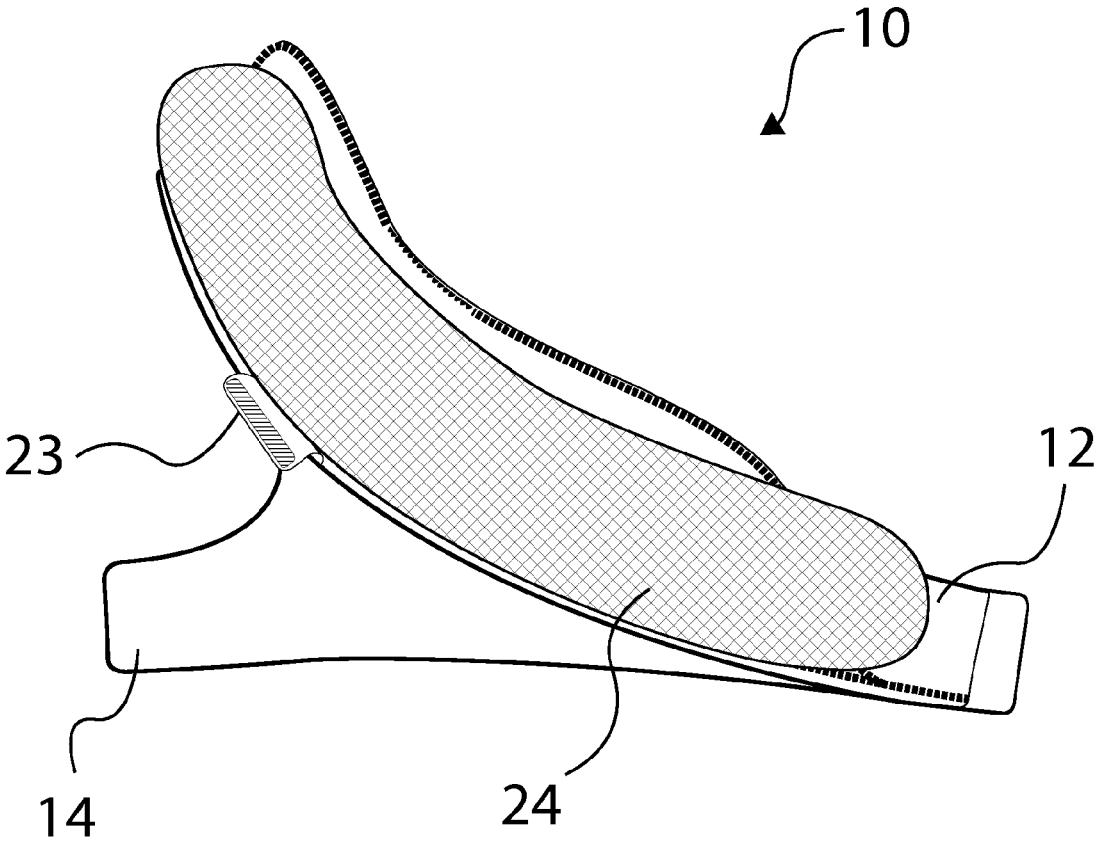
FIG. 12 is a fourth rear elevation view thereof showing the flotation device in a fully open and inflated configuration.

Referring back to FIG. 1, the pouch 12 is provided with a zipper 22 extending along a length thereof which allows the pouch 12 to be in a closed configuration as best shown in FIGS. 1 and 7. In other examples, other means such as fasteners in the form of hook and loop fastener strips sold under the trademark VELCRO® may be used to close the pouch 12. The pouch 12 houses an inflatable bladder 24 as best shown in FIGS. 3 and 9. When the bladder 24 is deflated the bladder fits snugly in the pouch 12. Unzipping the zipper 22 allows the pouch 12 to be in an open configuration exposing the bladder 24 as best shown in FIGS. 5 and 11.

Figure 13:
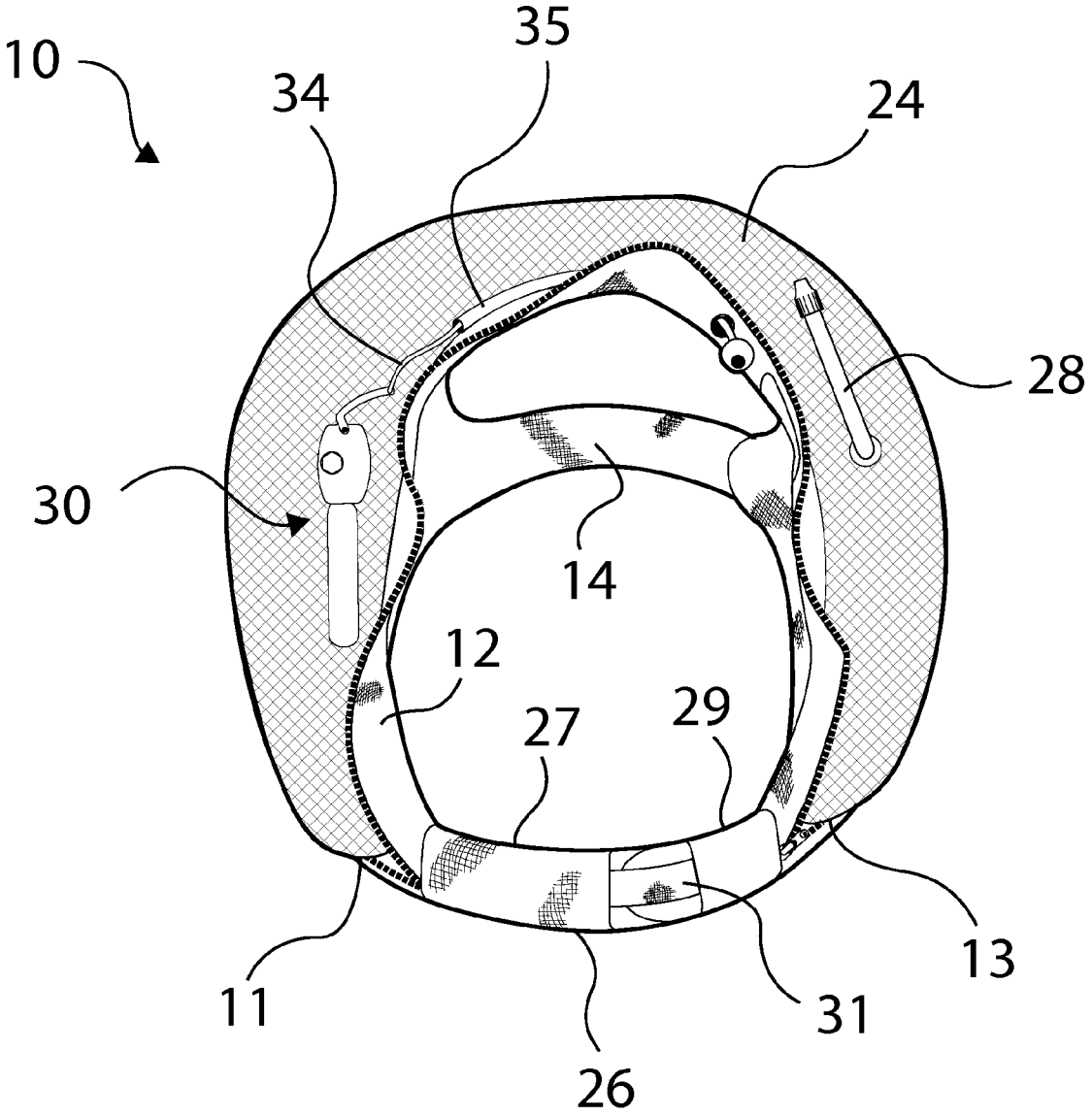
FIG. 13 is a top plan view of the flotation device in a fully open and inflated configuration as viewed from a right shoulder of a user.
Figure 14:
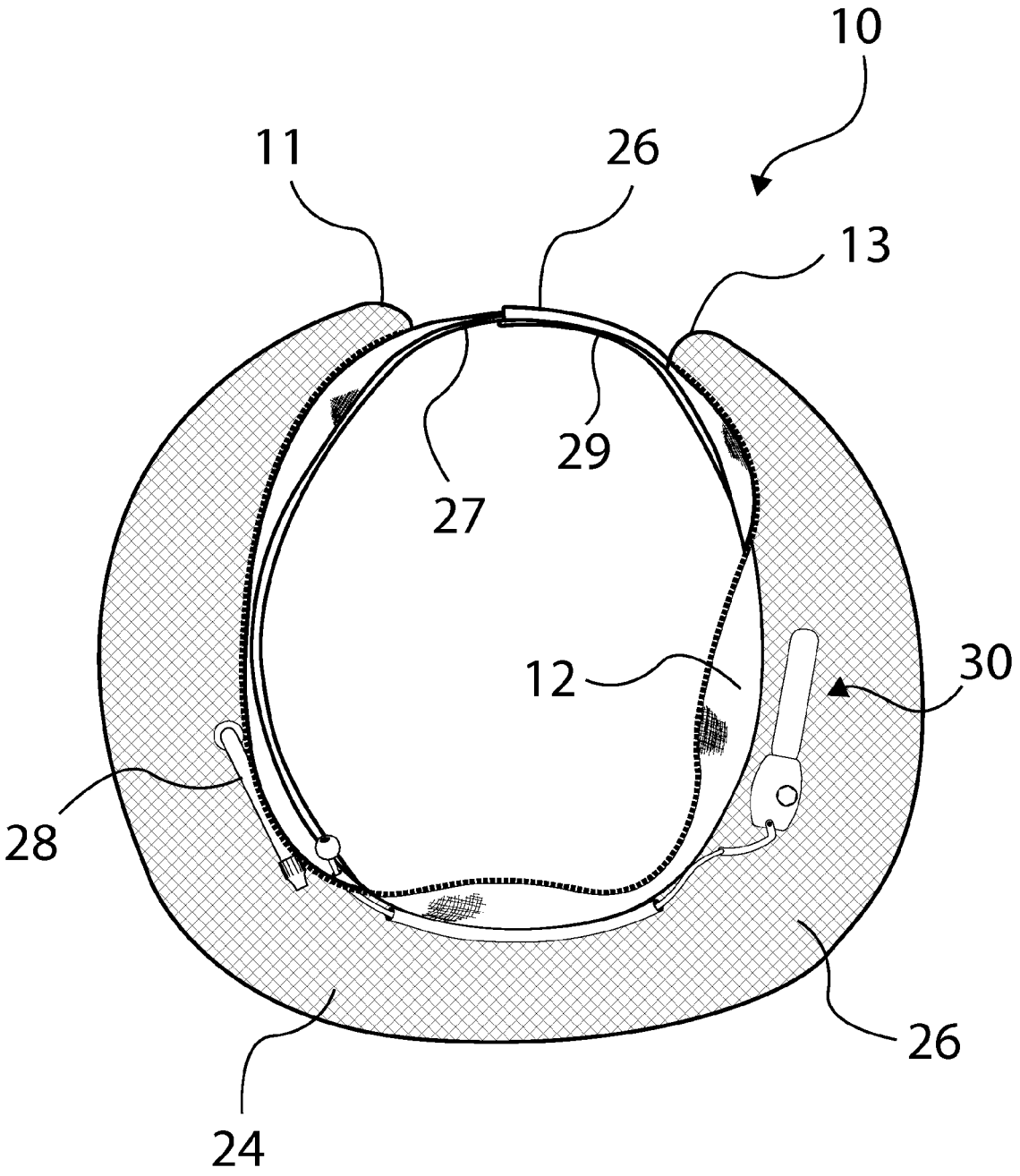
FIG. 14 is a top perspective view of the flotation device in a fully open and inflated configuration as viewed from a left shoulder of a user.

FIGS. 13 and 14 best show the loop-shaped shoulder strap 26 on which the pouch 12 is disposed. As shown in FIGS. 13 and 14, in this example, the pouch 12 does not extend completely about the shoulder strap 26. Rather ends 11 and 13 of the pouch 12 are spaced apart. End portions 27 and 29 of the shoulder strap 26 are free of the pouch 12. A fastener or mating connection in the form of a buckle 31 connects the end portions 27 and 29 of the shoulder strap 26 together and allows for adjustment of the shoulder strap 26. In other examples, the shoulder strap may be endless.

Figure 2:
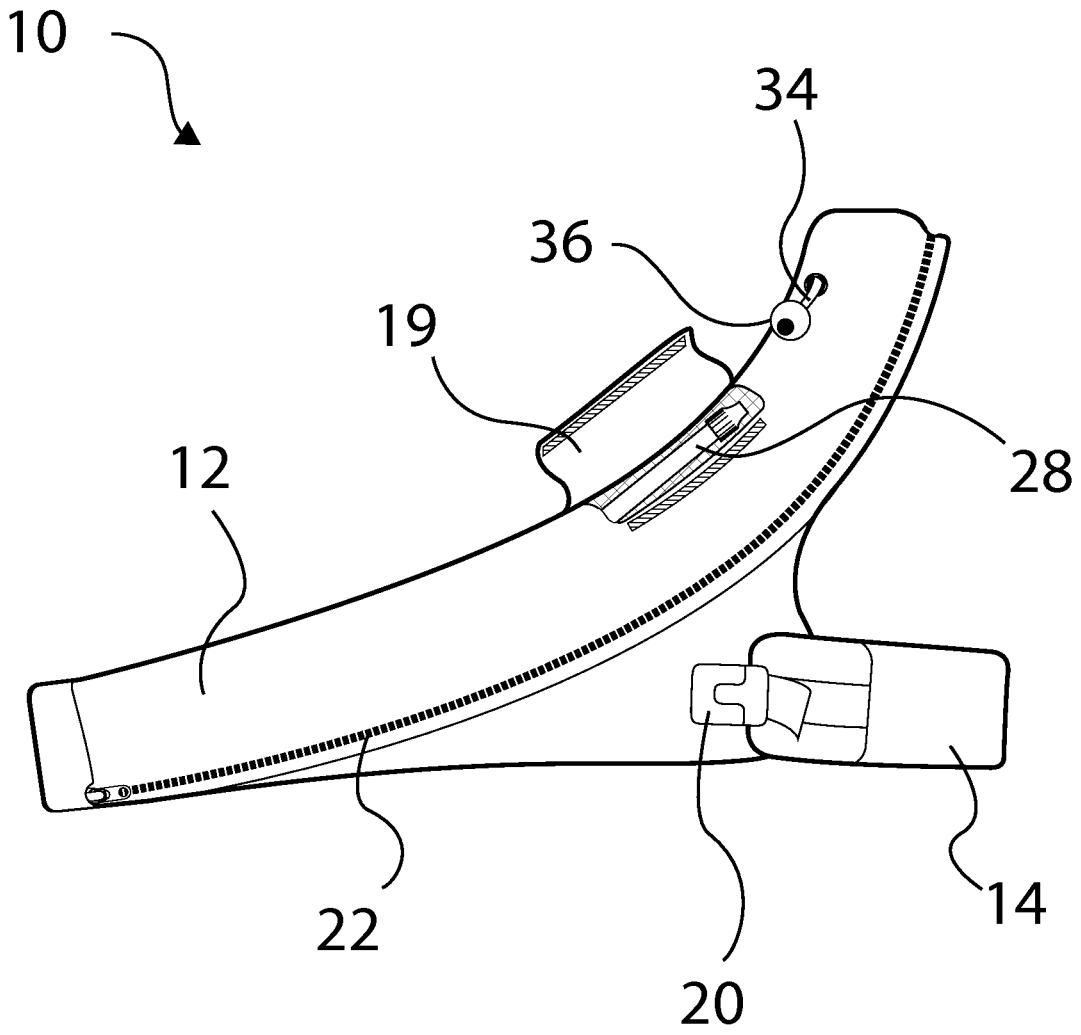
FIG. 2 is a first front elevation view thereof showing the flotation device in a closed and deflated configuration.

In this example, the flotation device 10 is provided with two inflation means or inflators. There is an oral inflation tube 28, best shown in FIG. 3, and a compressed gas inflation system 30, best shown in FIG. 11. The oral inflation tube 28 is in fluid communication with the bladder 24 and is provided with a two way valve 25 which is shown in FIG. 3 only. The two way valve 25 allows a user to manually inflate and deflate the bladder 24. In this example, the oral inflation tube 28 may be accessed by lifting an access flap 19 on the elongate pouch 12 as best shown in FIG. 2. Referring back to FIG. 11, the compressed gas inflation system 30 includes a compressed gas ($CO_2$ in this example) cartridge 32, a cartridge inflator 33 in fluid communication with the bladder 24, and a pull string 34 which when pulled actuates the cartridge inflator to puncture the compressed gas cartridge. This results in the discharge of gas into the bladder 24 and the inflation of the bladder. There is a handle 36 at a free end of the pull string 34 to facilitate pulling of the pull string. The pull string 34 is disposed in a sheath in the form of a polyethylene liner 35. The liner 35 cushions a user's shoulder from the pull string, particularly when the pull string 34 is pulled. In other examples other inflation means may be provided, for example, foam compressed in a canister may be used to inflate the bladder.

Figure 15:
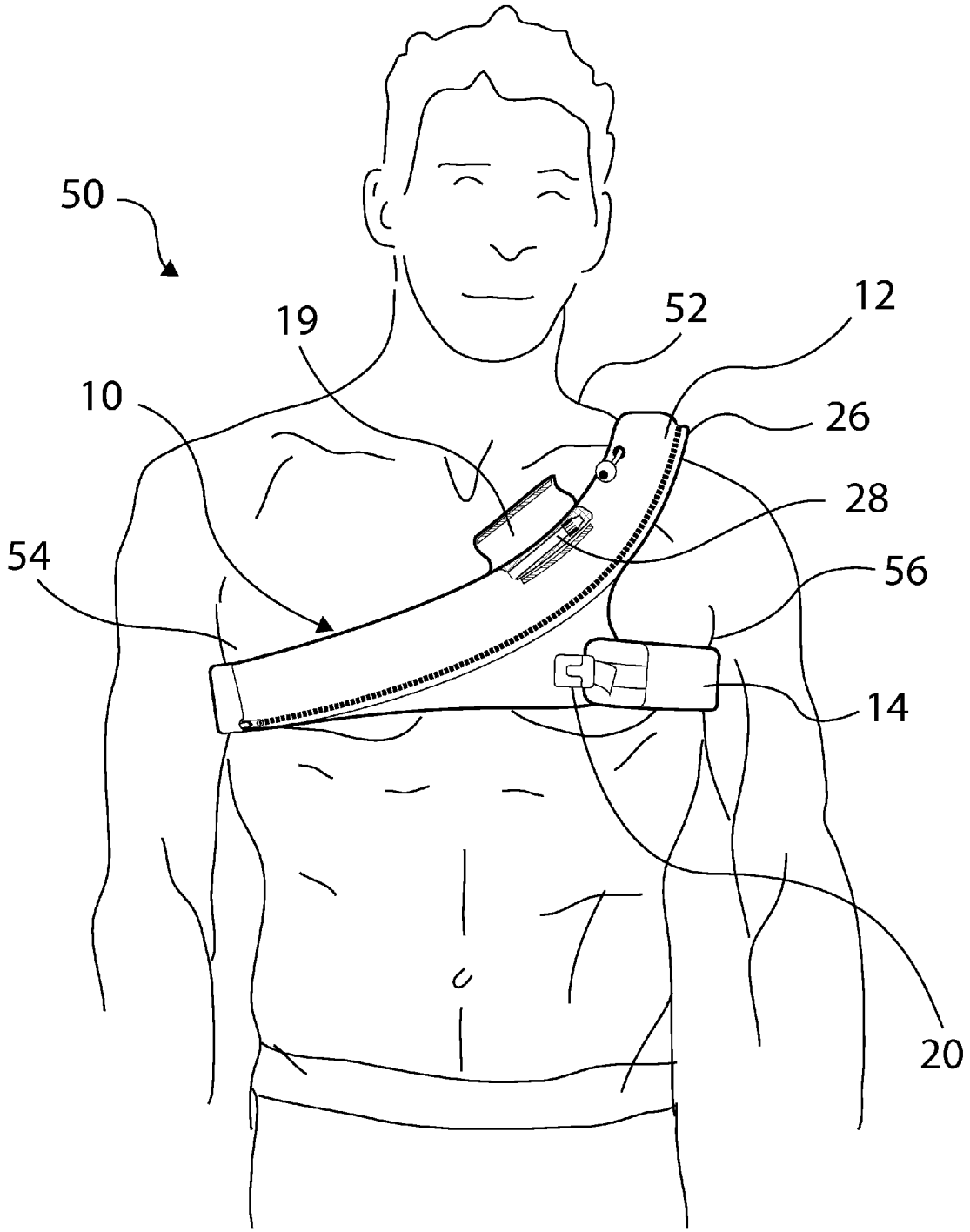
FIG. 15 is a front perspective view of a user wearing the flotation device showing the flotation device in a closed and deflated configuration.
Figure 17:
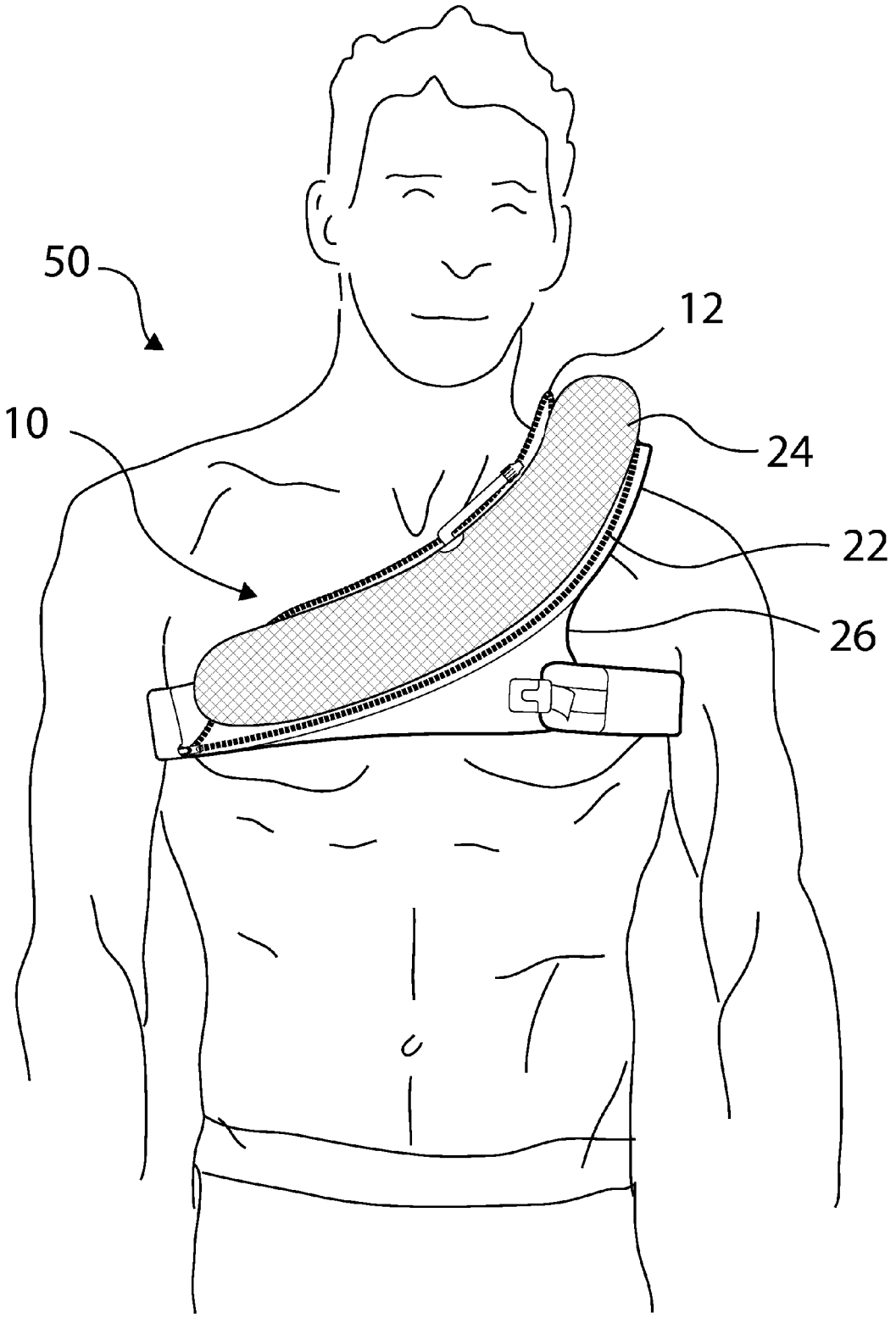
FIG. 17 is a front perspective view of the user wearing the flotation device showing the flotation device in a fully open and inflated configuration.
Figure 18:
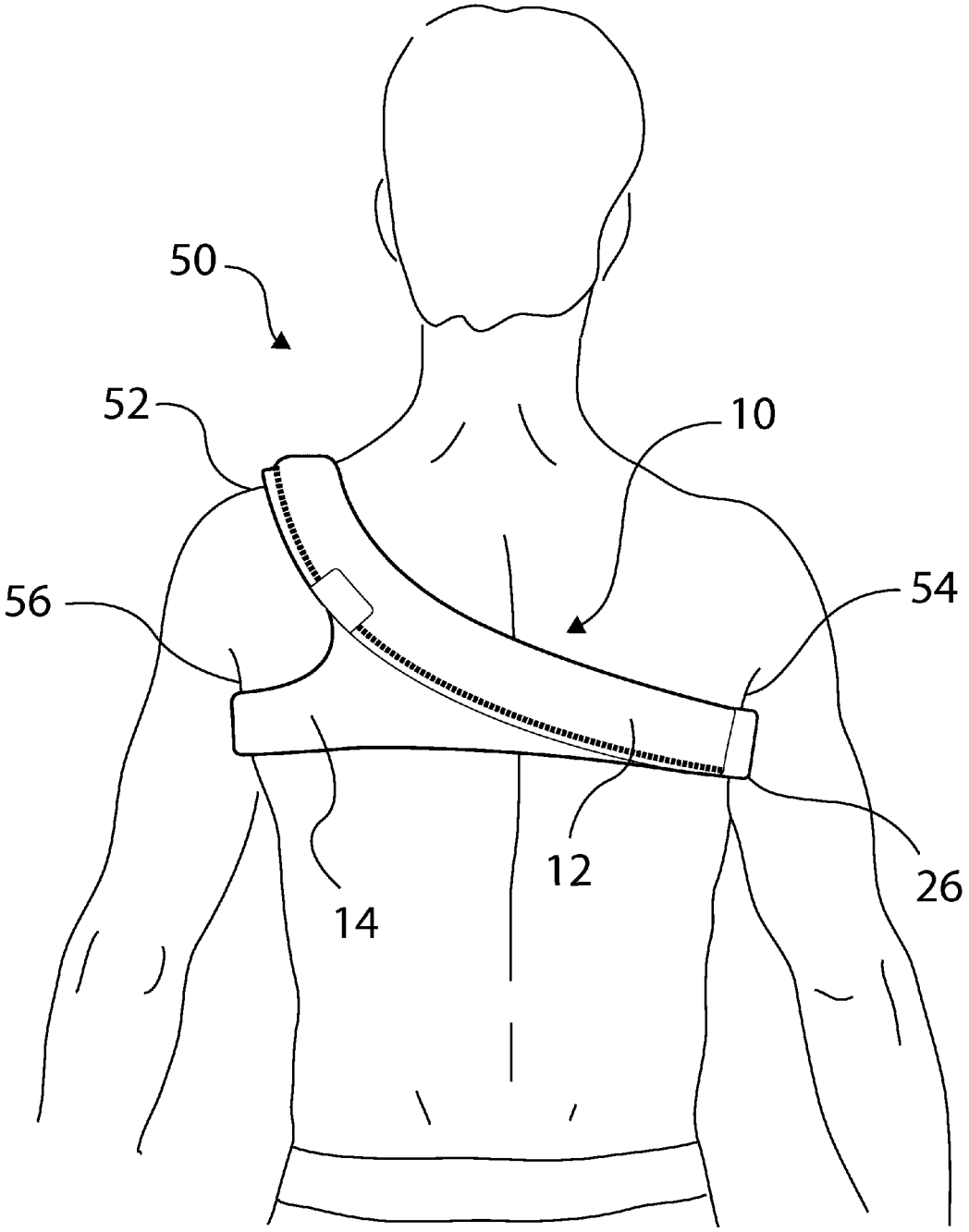
FIG. 18 is a rear perspective view of the user wearing the flotation device showing the flotation device in a closed and deflated configuration.
Figure 19:
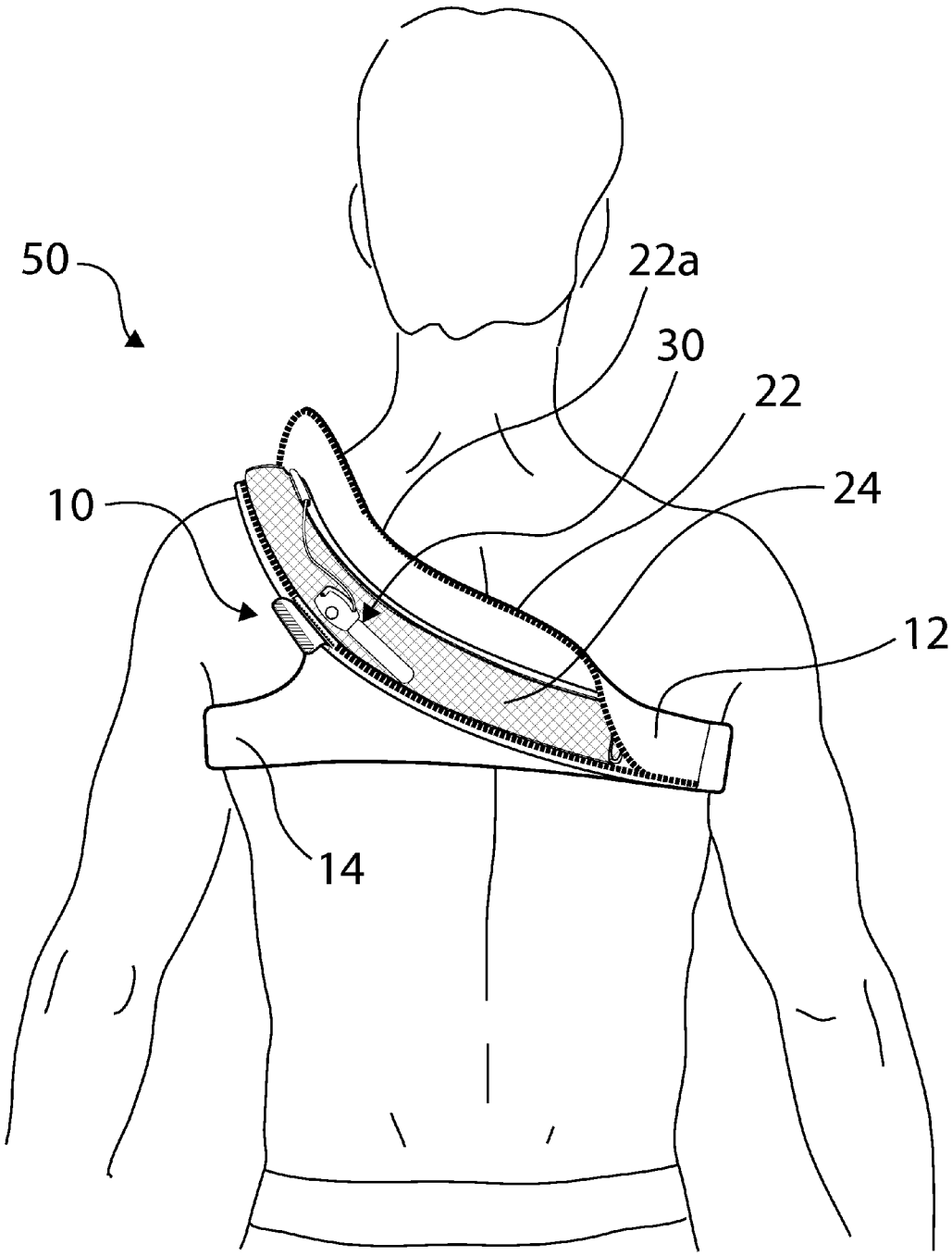
FIG. 19 is a rear perspective view of the user wearing the flotation device showing the flotation device in a fully open and deflated configuration.
Figure 20:
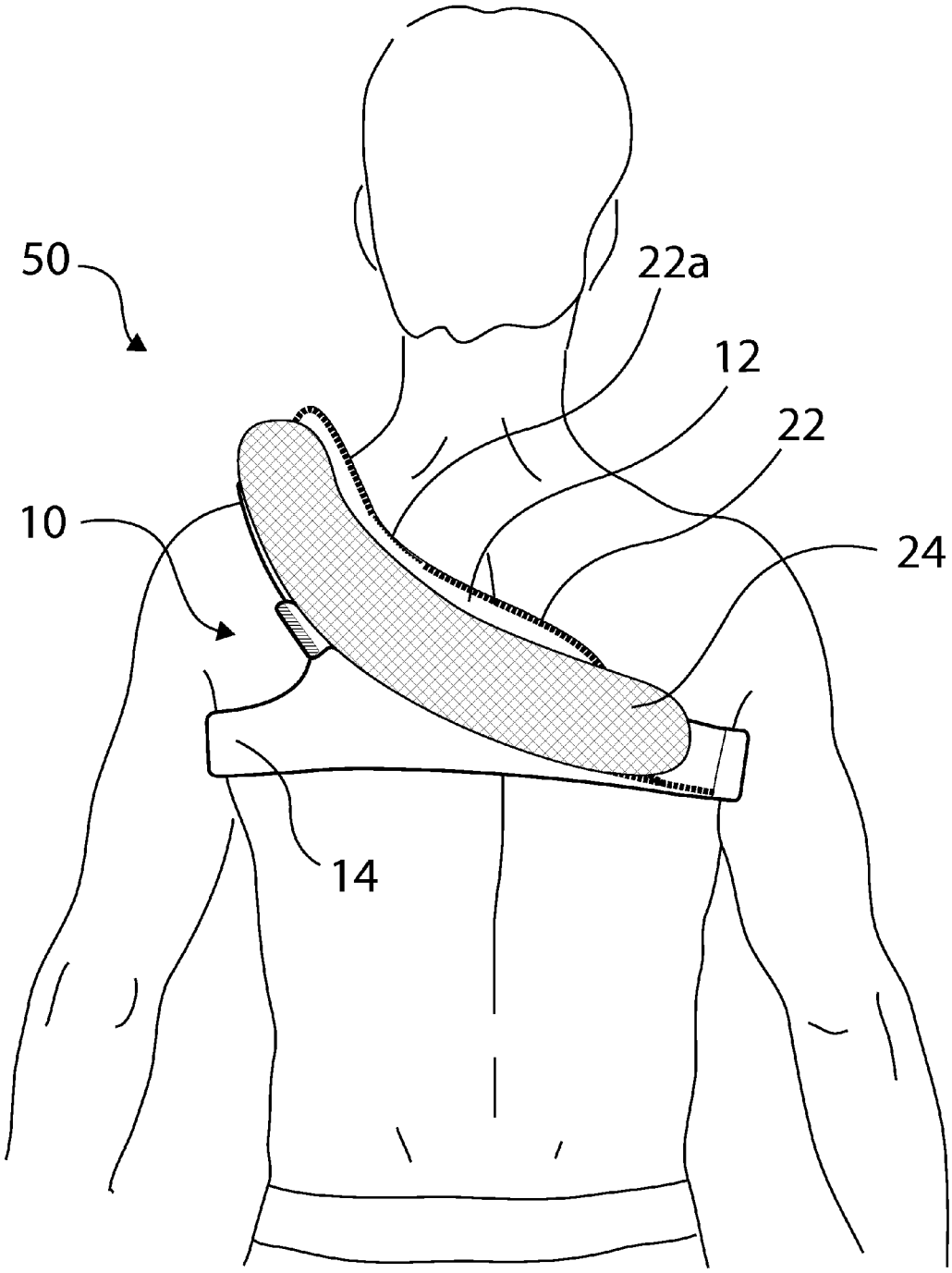
FIG. 20 is a rear perspective view of the user wearing the flotation device showing the flotation device in a fully open and inflated configuration.

In use, and as shown in FIGS. 15 and 17, a user 50 positions the shoulder strap 26 to extend over his shoulder 52 and under his arm 54 opposite to said shoulder 52. The cross strap 14 is thereby positioned under the other arm 56 of the user. The cross strap 14 and is connected to the pouch 12 by the buckle 20. This secures the flotation device 10 to the user in an unobtrusive manner and the flotation device 10 does not interfere with user motion.

Figure 16:
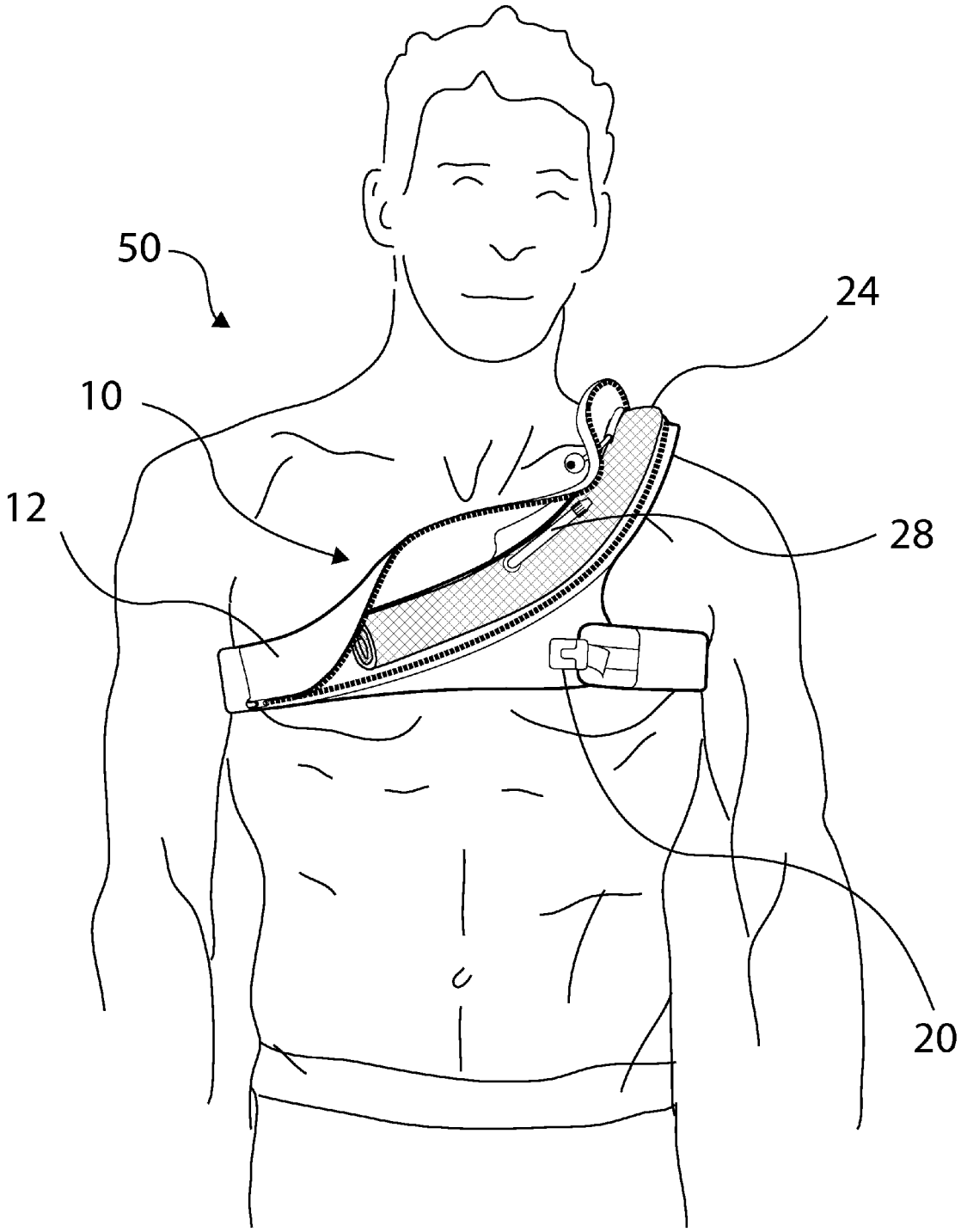
FIG. 16 is a front perspective view of the user wearing the flotation device showing the flotation device in a fully open and deflated configuration.

To deploy the flotation device 10 using the oral inflation tube 28 the user 50 may access the oral inflation tube through the access flap 19 as shown in FIG. 15 or the user may unzip the pouch 12 to access the oral inflation tube 28 as shown in FIG. 16. The bladder 22 may then be orally inflated to the state shown in FIGS. 17 and 20. The inflating bladder 24 automatically unzips the zipper 22 if the bladder is inflated by accessing the oral inflation tube 28 through the access flap 19.

To deploy the flotation device 10 using the compressed gas inflation system 30, the user 50 simply pulls the pull string 34 which extends through the pouch 22 as best shown in FIG. 1. The pull string 34 actuates the cartridge inflator 33 to puncture the compressed gas cartridge 33. This results in the discharge of gas into the bladder 24 and the inflation of the bladder. The inflating bladder 24 automatically unzips the zipper 22.

Figure 8:
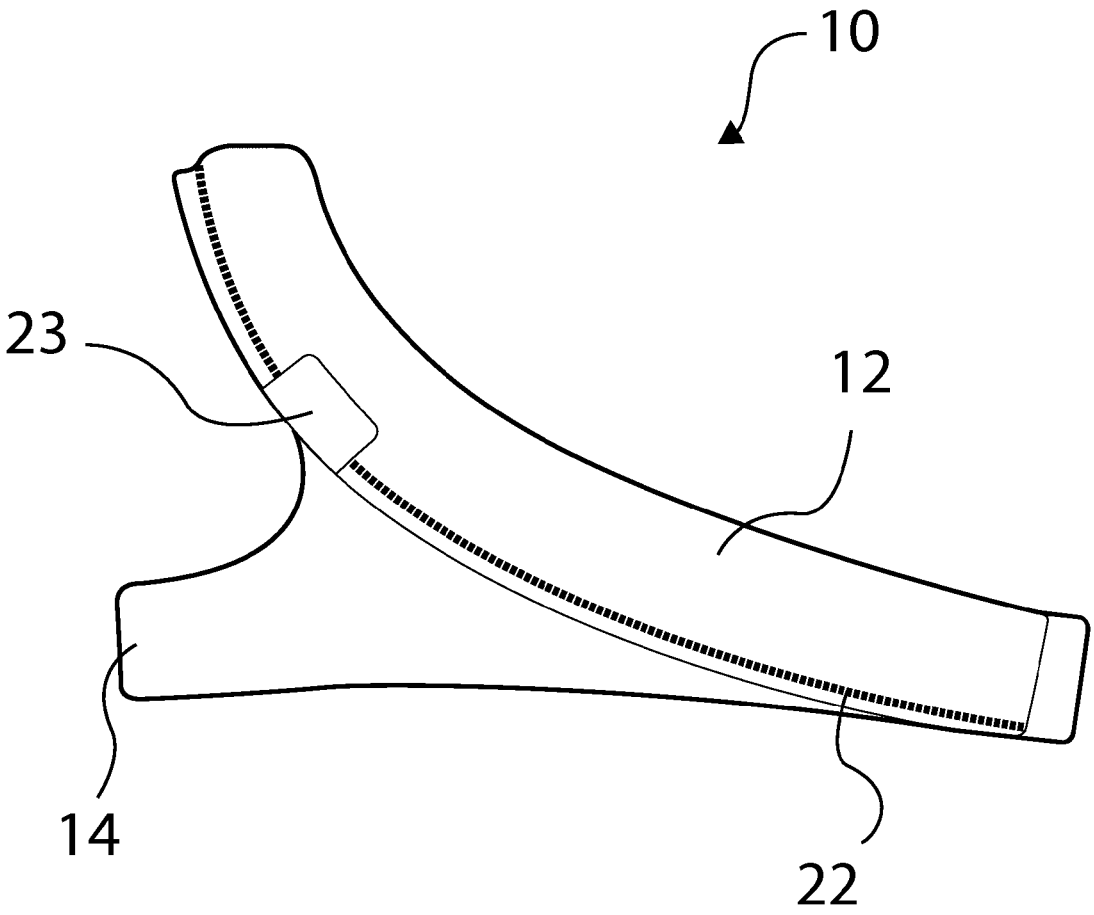
FIG. 8 is a first rear elevation view thereof showing the flotation device in a closed and deflated configuration.
Figure 10:
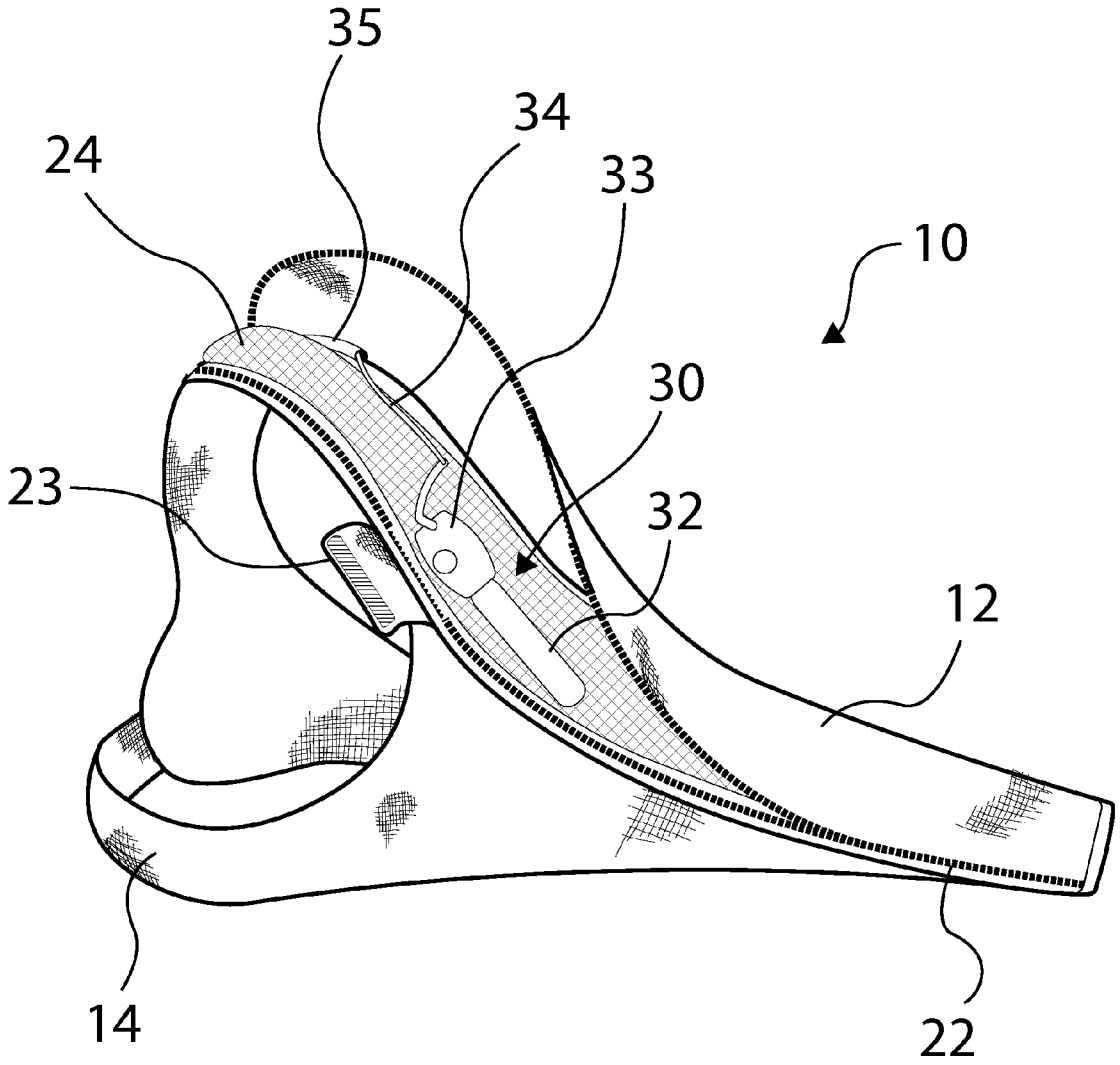
FIG. 10 is a rear perspective view thereof showing the flotation device in a partially open and deflated configuration.

The user 50 is not required to unzip the zipper 22 prior to deploying the flotation device 10 using the compressed gas inflation system 30. This is because a portion **22*a* of the zipper 22, best shown in FIGS. 9 to 11, is weakened and will burst open in response to the force from the inflating bladder. For example, the weakened portion 22*a* of the zipper 22 may be a QuickBurst™ zipper which will burst open in response to the force from the inflating bladder 24. There is a protective flap 23 which covers the QuickBurst™ zipper as shown in FIGS. 7 and 8**.

It will be understood by a person skilled in the art that in other examples the flotation device may include multiple bladders and the flotation device may be constructed from a variety of materials including but not limited to nylon, neoprene and polyurethane.

It will also be understood by a person skilled in the art that many of the details provided above are by way of example only, and are not intended to limit the scope of the invention which is to be determined with reference to the following claims.

What is claimed is:

1. A flotation device for a user, the flotation device comprising:

a shoulder strap;

a cross strap connected to the shoulder strap;

an inflatable bladder extending along the shoulder strap; and wherein the shoulder strap is configured to extend over one shoulder of the user and under a first arm of the user, the first arm of the user being opposite to the said one shoulder of the user, and the cross strap being configured to extend under a second arm of the user but not substantially below armpits of the user.

2. The flotation device as claimed in claim 1 further including an oral inflation tube in fluid communication with the inflatable bladder.

3. The flotation device as claimed in claim 2 wherein the inflatable bladder is disposed within a pouch, and the pouch includes a flap for accessing the oral inflation tube.

4. The flotation device as claimed in claim 2 wherein the oral inflation tube includes a two-way valve.

5. The flotation device as claimed in claim 1 further including a compressed gas inflation system which includes a compressed gas cartridge, a cartridge inflator in fluid communication with the inflatable bladder, and a pull string which when pulled actuates the cartridge inflator to puncture the compressed gas cartridge resulting in compressed gas being discharged into the inflatable bladder.

6. The flotation device as claimed in claim 5 wherein the pull string is disposed within a liner.

7. The flotation device as claimed in claim 5 wherein the inflatable bladder is disposed within a pouch, and the pull string extends through the pouch.

8. The flotation device as claimed in claim 1 wherein the cross strap is releasably connected to the shoulder strap.

9. The flotation device as claimed in claim 1 wherein the shoulder strap is adjustable.

10. The flotation device as claimed in 1 wherein the inflatable bladder is disposed within a pouch.

11. The flotation device as claimed in claim 1 wherein the cross strap is substantially horizontal when the user is standing upright.

12. A flotation device for a user, the flotation device comprising:

an adjustable shoulder strap;

a cross strap releasably connected to the shoulder strap;

a pouch extending along the shoulder strap;

an inflatable bladder disposed within the pouch; and an inflation means for inflating the inflatable bladder;

wherein the shoulder strap is configured to extend over one shoulder of the user and under a first arm of the user, the first arm of the user being opposite to the said one shoulder of the user, and the cross strap being configured to extend under a second arm of the user and extend substantially horizontal when the user is upright.

13. The flotation device as claimed in claim 12 wherein the inflation means is an oral inflation tube in fluid communication with the inflatable bladder.

14. The flotation device as claimed in claim 13 wherein the pouch includes a flap for accessing the oral inflation tube.

15. The flotation device as claimed in claim 13 wherein the oral inflation tube includes a two-way valve.

16. The flotation device as claimed in claim 12 wherein the inflation means is a compressed gas inflation system which includes a compressed gas cartridge, a cartridge inflator in fluid communication with the inflatable bladder, and a pull string which when pulled actuates the cartridge inflator to puncture the compressed gas cartridge resulting in compressed gas being discharged into the inflatable bladder.

17. The flotation device as claimed in claim 16 wherein the pull string is disposed within a liner.

18. The flotation device as claimed in claim 16 wherein the pull string extends through the pouch.

19. A flotation device for a user, the flotation device comprising:

an adjustable shoulder strap;

a cross strap releasably connected to the shoulder strap;

a pouch extending along the shoulder strap;

an inflatable bladder disposed within the pouch;

an oral inflation tube in fluid communication with the inflatable bladder, the pouch including a flap for accessing the oral inflation tube and the oral inflation tube including a two-way valve;

a compressed gas inflation system which includes a compressed gas cartridge, a cartridge inflator in fluid communication with the inflatable bladder, and a pull string which when pulled actuates the cartridge inflator to puncture the compressed gas cartridge resulting in compressed gas being discharged into the inflatable bladder, the pull string being disposed within a liner and extending through the pouch; and wherein the shoulder strap is configured to extend over one shoulder of the user and under a first arm of the user, the first arm of the user being opposite to the said one shoulder of the user, and the cross strap being configured to extend under a second arm of the user and extend substantially horizontal when the user is upright.

* * * * *